US006814621B2

(12) United States Patent
Lu

(10) Patent No.: US 6,814,621 B2
(45) Date of Patent: Nov. 9, 2004

(54) CURRENT TAP STRUCTURE

(76) Inventor: Chong Ying Lu, No. 1326, Gungyi Rd., Junan Jen, Miaoli (TW), 350

( * ) Notice: Subject to any disclaimer, the term of this patent is extended or adjusted under 35 U.S.C. 154(b) by 0 days.

(21) Appl. No.: 10/372,135

(22) Filed: Feb. 25, 2003

(65) Prior Publication Data

US 2004/0166738 A1 Aug. 26, 2004

(51) Int. Cl.[7] ..... H01R 13/68; H01R 33/95
(52) U.S. Cl. ..... 439/622
(58) Field of Search ..... 439/621, 622

(56) References Cited

U.S. PATENT DOCUMENTS 5,320,563 A * 6/1994 Liao ..... 439/622
5,451,173 A * 9/1995 Mai ..... 439/622
5,482,478 A * 1/1996 Liao ..... 439/622
6,325,673 B1 * 12/2001 Mai ..... 439/622

* cited by examiner

*Primary Examiner*—Javaid H. Nasri
(74) *Attorney, Agent, or Firm*—Rosenberg, Klein & Lee

(57) ABSTRACT

An improved current tap structure comprises an outer body with an inner body disposed therein. Two parallel grooves are provided in the inner body to receive and position two U-shaped contacts and two lead wires connected therewith. Two blades are provided at two sides of the grooves. The blades and the lead wires are exposed from a plug face and the bottom face of the outer body, respectively. Notches are provided between barriers at two sides of the grooves and an outlet plate of the inner body so that the U-shaped contacts and the lead wires connected therewith can slide into the grooves from the notches. Thereby, the effect of simplifying the assembly steps can be achieved, and the advantages of quick processing speed, low assembly cost and low price can also be accomplished.

1 Claim, 5 Drawing Sheets

CURRENT TAP STRUCTURE

FIELD OF THE INVENTION

The present invention relates to an improved current tap structure and, more particularly, to a current tap structure capable of simplifying the assembly steps.

BACKGROUND OF THE INVENTION

A long with flourishing development of the science and technology industry, use of electric appliances is indispensable in everyday works and lives. When electrical appliances are to be used, current taps need to be plugged into sockets to provide electricity. Therefore, the safety consideration of the current tap structure is very important.

FIG. 1 shows the structure of a conventional safety current tap. An inner body 12 is provided in an outer body 10. Barriers 14 are provided at the left and right sides of the inner body 12 to form two grooves 16 for receiving two fuses 20, two U-shaped contacts 22 and two lead wires 24 connected therewith. Two blades 18 are provided at two sides of the grooves 16. Two ends of the fuses 18 are electrically connected to the blades 18 and the U-shaped contacts 22. This design makes use of the fuses to take safety into consideration.

In the above conventional safety current tap structure, the barriers 14 at the two sides of the inner body 12 are extended and connected to an outlet plate 26, and openings (not shown) are provided at the bottom faces of the two grooves 16 in consideration of assembly convenience so that the U-shaped contacts 22 and the lead wires 24 connected therewith can pass through the openings from bottom to top for subsequent steps like positioning. The assembly process of the U-shaped contacts in the conventional safety current tap comprises the following steps:

1. The U-shaped contacts are aimed at the openings from the bottoms of the grooves 16;
2. The U-shaped contacts 22 and the lead wires 24 pass through the openings;
3. The U-shaped contacts 22 arc moved to rivet points to aim at the grooves 16.
4. The U-shaped contacts 22 are pressed into the grooves.
5. The lead wires 24 are pulled downwards; and
6. The U-shaped contacts 22 are pressed downwards for positioning.

For the conventional safety current tap structure, the assembly process is cumbersome and inconvenient. Moreover, the conventional safety current tap has the problems of slow processing speed and high processing cost. Accordingly, the present invention aims to propose an improved current tap structure to resolve the problems in the prior art.

SUMMARY AND OBJECTS OF THE PRESENT INVENTION

The primary object of the present invention is to provide an improved current tap structure to effectively simplify the assembly process so as to resolve the problem of cumbersome assembly process in the prior art.

Another object of the present invention is to provide a current tap structure of easy assembly to simultaneously have the advantages of quick processing speed, low assembly cost and low price.

According to the present invention, an improved current tap structure comprises an outer body. An inner body is provided in the outer body. Three barriers are provided in the inner body to form two grooves for receiving and positioning two U-shaped contacts and two lead wires connected therewith. Two blades are provided at two sides of the grooves. The blades and the lead wires are exposed from the outer body. Notches are provided between the barriers at two sides of the grooves and an outlet plate of the inner body so that the U-shaped contacts and the lead wires connected therewith can slide into the grooves from the-notches.

The various objects and advantages of the present invention will be more readily understood from the following detailed description when read in conjunction with the appended drawings, in which:

DETAILED DESCRIPTION OF PREFERRED EMBODIMENT

Figure 1:
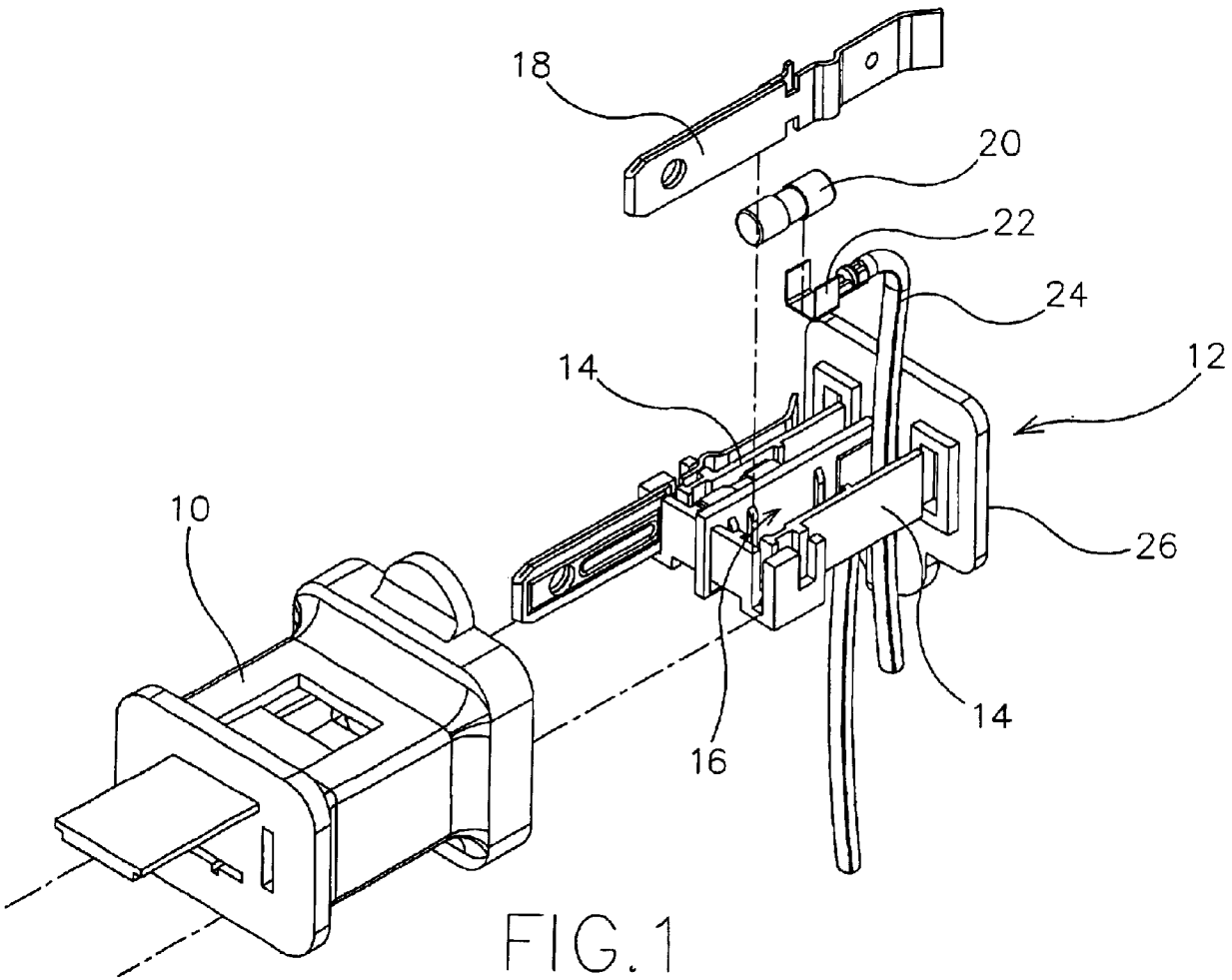
FIG. 1 PRIOR ART
FIG. 1 is a partly exploded perspective view of a conventional current tap structure.
Figure 2:
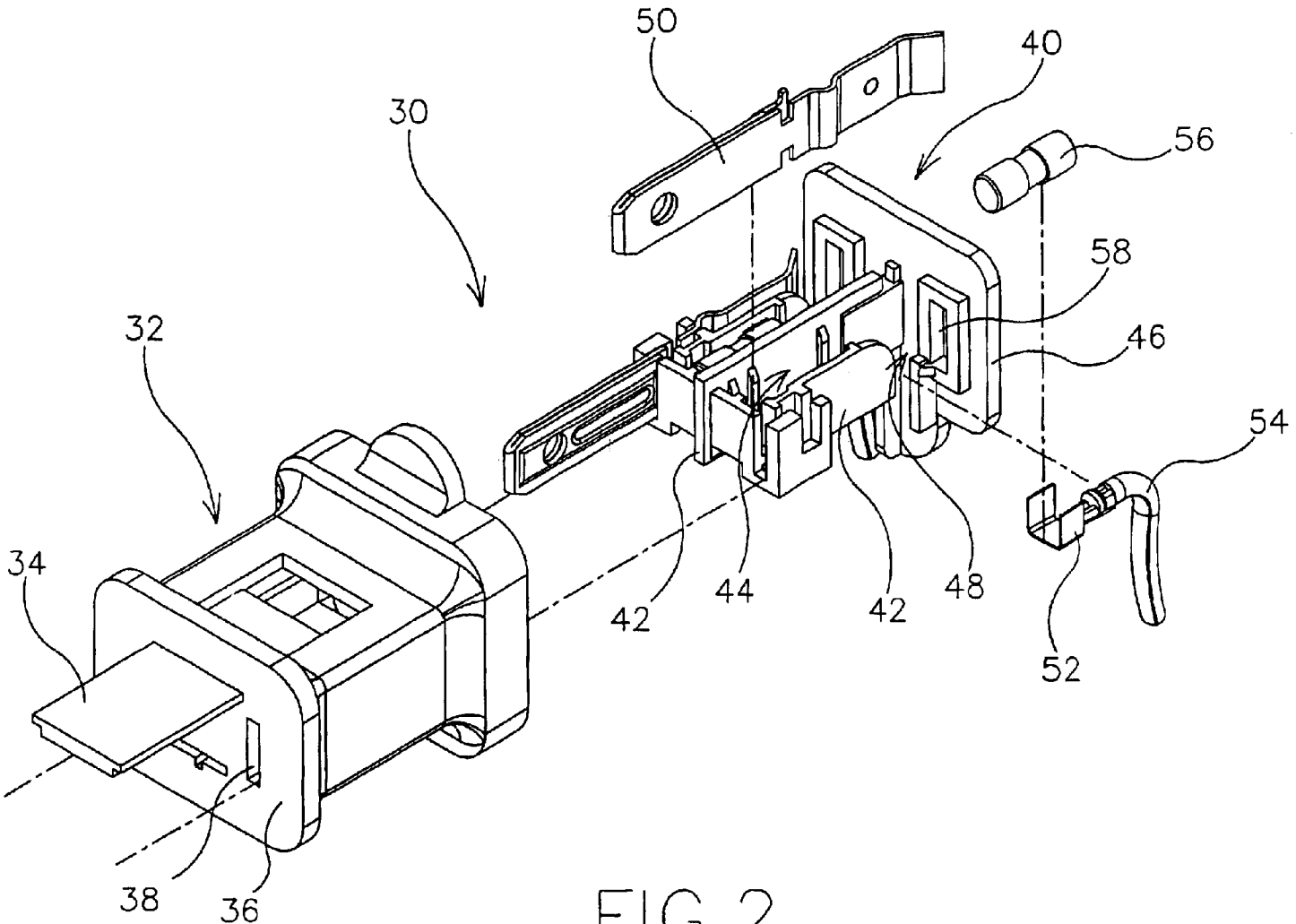
FIG. 2 is a partly exploded perspective view of a current tap structure of the present invention.
Figure 3:
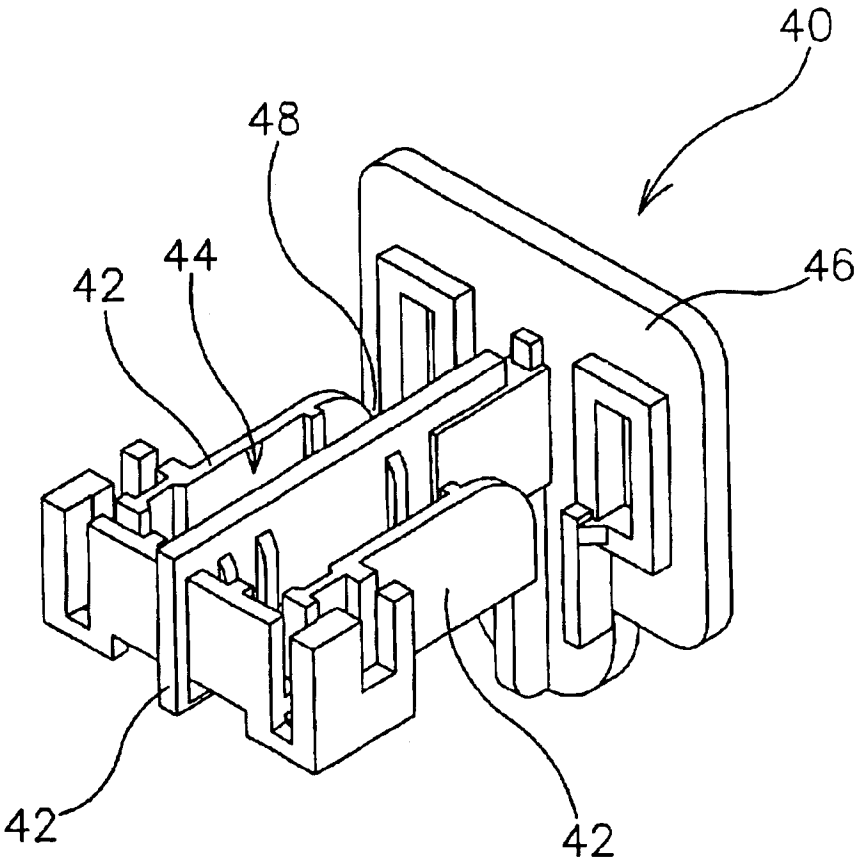
FIG. 3 is a perspective view of the inner body of a current tap structure of the present invention.

As shown in FIG. 2, a current tap 30 of the present invention comprises an outer body 32. An openable fuse door 34 is provided at the top face of the outer body 32. Two blade openings 38 are formed at a plug face 36 of the outer body 32. An inner body 40 is provided in the outer body 32. Please also refer to FIG. 3. Barriers 42 are provided at the center and the left and right sides of the inner body 40 to form two parallel grooves 44. The barriers 42 at the left and right sides are shorter. Notches 48 are formed between the barriers at the two sides of the inner body 40 and an outlet plate 46.

Figure 4:
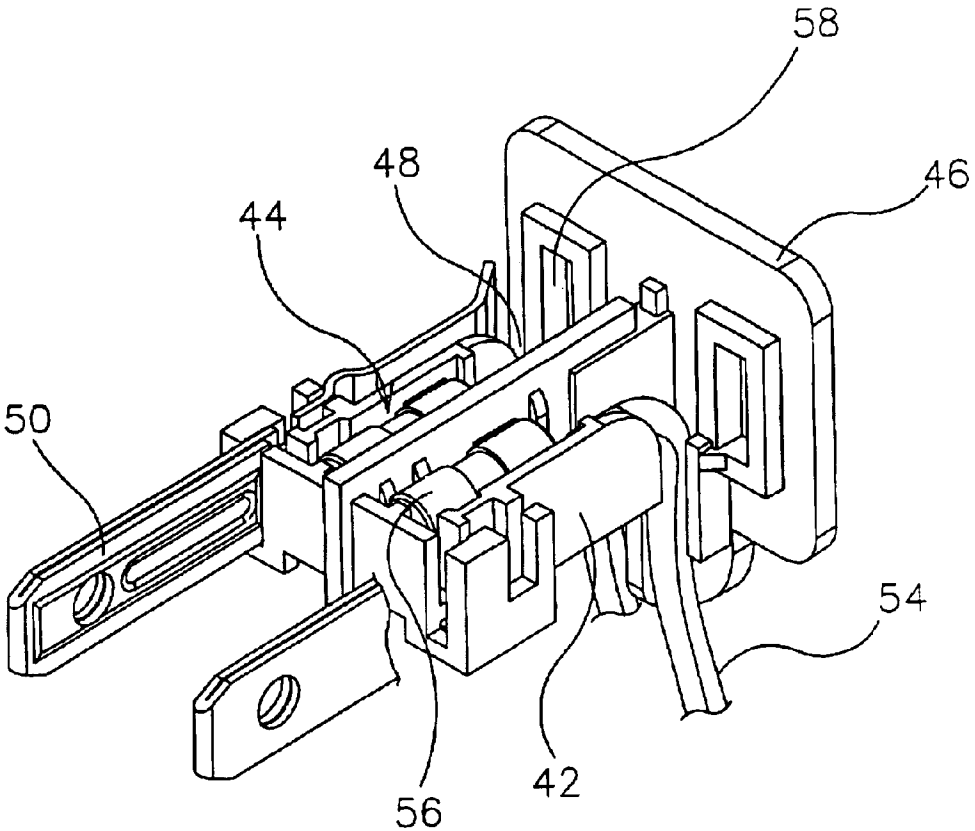
FIG. 4 is an assembly diagram of each component in the inner body of the present invention.
Figure 5:
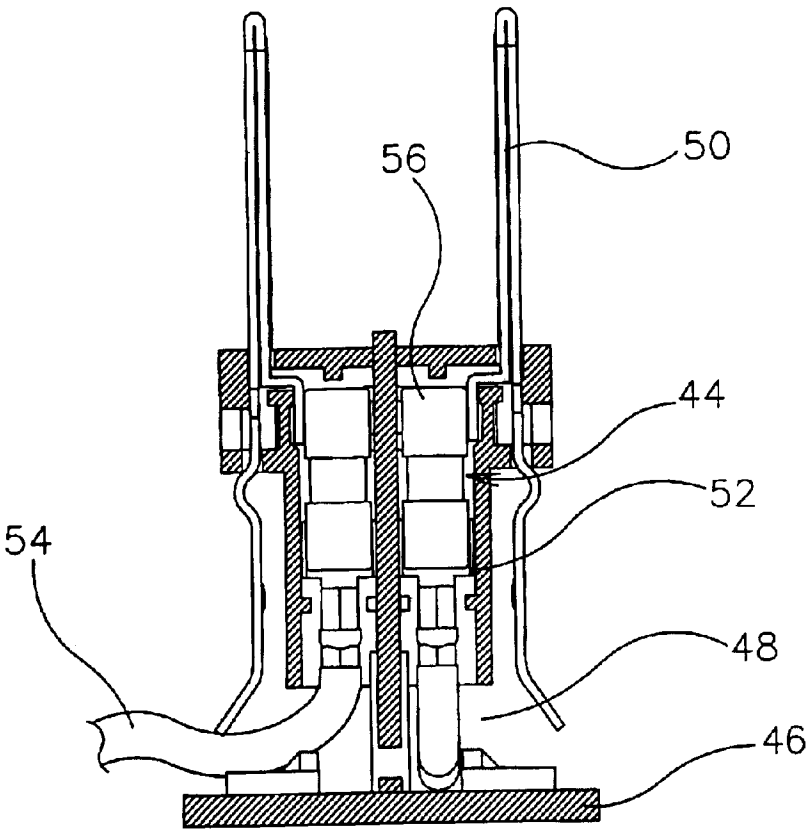
FIG. 5 is a cross-sectional view of FIG. 4.

Please further refer to FIGS. 4 and 5 at the same time. The shape of the grooves 44 can exactly receive and position two U-shaped contacts 52 and lead wires 54 connected therewith. A receiving room is formed in each of the grooves 44 for installation of a fuse 56. Two blades 50 are provided at two sides of the grooves 44. Two ends of the fuses 56 are electrically connected to the blades 50 and the U-shaped contacts 52. Two outlet openings 58 are formed at the outlet plate 46 of the inner body 40 and corresponding to the blades 50 for providing the function of tail plugging.

After all components in the inner body 40 are installed, the inner body 40 and the outer body 32 are assembled together to let the blades 50 and the lead wires 54 be exposed from the blade openings 38 and the bottom face of the outer body 32, respectively. The fuse door 34 can be opened for replacement of the fuses 56 in the grooves 44.

Because notches 48 are formed between the barriers 42 at the two sides of the inner body 40 and the outlet plate 46, when the U-shaped contacts 52 are installed in the grooves 44, the U-shaped contacts 52 and the lead wires connected therewith directly slide in the grooves 44 from the notches 48.

Therefore, the assembly process of the U-shaped contacts 52 comprises the following steps:

1. The U-shaped contacts 52 and the lead wires 54 connected therewith slide in the grooves 44 from the notches 48.

2. The U-shaped contacts 52 are pressed in the grooves 44 from above the grooves 44.

3. The lead wires 54 are pulled downwards; and

4. The U-shaped contacts 52 are pressed downwards for positioning.

As compared to the assembly process of the conventional U-shaped contacts, the structure provided by the present invention can reduce the assembly steps and simplify the assembly work.

To sum up, in the improved current tap structure of the present invention, notches are provided between the barriers at two sides of the inner body and the outlet plate so that the U-shaped contacts can directly slide in the grooves from the notches, hence effectively accomplishing the effect of simplifying the assembly process. The present invention also has the advantages of quick processing speed and low assembly cost.

Although the present invention has been described with reference to the preferred embodiments thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An improved current tap structure comprising:

an outer body; and an inner body extending from an outlet plate, said inner body being disposed in said outer body, at least three barriers laterally spaced one from the other being provided in said inner body to form two grooves for receiving and positioning two U-shaped contacts and two lead wires connected therewith, two blades being provided at two sides of said grooves, said blades and said lead wires being exposed from said outer body, outer ones of said barriers each having an arcuate free end offset from said outlet plate by a notch space communicating with one said groove, said notch space being greater in width than each of said U-shaped contacts for receiving laterally therethrough said U-shaped contacts and said lead wires connected therewith.

* * * * *